US005156205A

United States Patent [19]

Prasad

[11] Patent Number: 5,156,205

[45] Date of Patent: Oct. 20, 1992

[54] METHOD OF DETERMINING VERTICAL PERMEABILITY OF A SUBSURFACE EARTH FORMATION

[76] Inventor: Raj K. Prasad, 3444 Normandy Ave., Dallas, Tex. 75205

[21] Appl. No.: 726,778

[22] Filed: Jul. 8, 1991

[51] Int. Cl.[5] ..... E21B 47/00; E21B 47/10

[52] U.S. Cl. ..... 166/250; 73/155

[58] Field of Search ..... 166/250, 252, 298; 73/155

[56] References Cited

U.S. PATENT DOCUMENTS

| | | | |
|---|---|---|---|
| 3,148,730 | 9/1964 | Holbert | 166/9 |
| 3,604,256 | 9/1971 | Prats | 73/155 |
| 3,771,360 | 11/1973 | Prats | 73/155 |
| 3,896,413 | 7/1975 | Dowling et al. | 340/15.5 |
| 4,502,010 | 2/1985 | Kuckes | 324/338 |
| 4,766,958 | 8/1988 | Faeke | 166/269 |
| 4,803,873 | 2/1989 | Ehlig-Economides | 73/155 |
| 4,860,581 | 8/1989 | Zimmerman et al. | 73/155 |
| 4,890,487 | 1/1990 | Dussan | 73/152 |
| 4,941,350 | 7/1990 | Schneider | 73/155 |

*Primary Examiner*—Stephen J. Novosad
*Attorney, Agent, or Firm*—Harrison & Egbert

[57] ABSTRACT

A method of determining vertical permeability of a subsurface earth formation having the steps of perforating a production casing for an initial area less than a thickness of the subsurface earth formation, measuring reservoir fluid flow and pressure through the initial area perforation, perforating the production casing for a production interval of an area greater than the initial area perforation, measuring reservoir fluid flow and pressure through the perforated production interval, establishing a value corresponding to horizontal permeability from the measured reservoir fluid flow and pressure through the perforated production interval, simulating pressure profiles using values of vertical permeability in combination with the established value of horizontal permeability, and determining the simulated pressure profile which generally corresponds to a measured pressure profile from the initial area perforation. The method further includes the step of cementing through the perforated initial area to an exterior of the production casing so as to inhibit vertical fluid communication and reperforating the perforated initial area so as to allow reservoir fluid flow to enter the production casing.

18 Claims, 3 Drawing Sheets

METHOD OF DETERMINING VERTICAL PERMEABILITY OF A SUBSURFACE EARTH FORMATION

TECHNICAL FIELD

The present invention relates to methods for determining the permeability of a subsurface earth formation traversed by a borehole. More particularly, the present invention relates to methods and techniques for the determination and measurement of vertical permeability.

BACKGROUND ART

Crude oil in commercial quantities is generally found in the pore space in sedimentary rocks; less than one percent of the world's oil has been found in fractures in igneous or metamorphic rocks, about fifty-nine percent has been found in pores between the mineral grains of sandstones, and about forty percent in the void space present in dolomites or limestones (carbonates).

The two most important characteristics of a reservoir rock are its porosity and its permeability. Porosity is defined as the ratio of the volume of pore space to the total bulk volume of the material expressed in percent. Permeability is the capacity of the rock to transmit fluids through the interconnected pore spaces of a rock; the customary unit of measurement is the millidarcy. Although there often is an apparent close relationship between porosity and permeability, because a highly porous rock may be highly permeable, there is no real relationship between the two; a rock with a high percentage of porosity may be very impermeable because of a lack of communication between the individual pores or because of capillary size of the pore space.

After a borehole has penetrated the possibly productive formations, these formations must be tested to determine if expensive completion procedures should be used. The first evaluation is usually made by well-logging methods, in which the logging tool is lowered past the formations while the response signals are relayed to operators on the surface. Often these tools make use of the differences in electrical conductivities of rocks, water, and petroleum to detect possible oil or gas accumulations. Other logging tools depend on difference in absorption of atomic particles. Well-logging tools identify the productive formations which are further verified by a production test.

If the preliminary tests show that one or more of the formations in the borehole will be commercially productive, the well must be prepared for the production of the oil or gas. First, a large outside pipe, or casing, slightly smaller in diameter than the drill hole, is inserted into the full depth of the well. A cement slurry is forced between the outside of the casing and the inside surface of the drill hole. When set, this cement forms a seal so that fluids cannot pass from one portion of the well to the other through the borehole. The casing is usually about nine inches (23 centimeters) in diameter. It creates a permanent well through which the productive formations may be reached. After the casing is in place, a production string of smaller tubing is extended from the surface to the productive formation with a packing device to seal the productive interval from the rest of the well. If multiple productive formations are found, as many as four production strings of tubing may be hung in the same cased well. If a pump is needed to lift oil to the surface, it is placed on the bottom of the production string.

Since the casing is sealed against the productive formation, openings must be made to allow the oil or gas to enter the well. A down-hole perforator uses an explosive to shoot holes through the casing and cement into the formation. The perforator tool is lowered through the tubing on a wire line. When it is in the correct position, the charges are fired electrically from the surface. Such perforating will be sufficient if the formation is quite productive. If not, an inert fluid may be injected into the formation at pressures high enough to fracture the rock around the well and thus open more flow passages for the petroleum. In early times, nitroglycerin was exploded in the well bore for the same purpose.

The permeability of an earth formation containing valuable resources is a parameter of major significance to the economic production of the resource. These resources are generally located by borehole logging which measures the resistivity and porosity of the formation in the vicinity. Such measurements enable porous zones to be identified and their water saturation (percentage of pore space occupied by water) to be estimated. A value of water saturation significantly less than unity is taken as being indicative of the presence of hydrocarbons, and may also be used to estimate their quantity. However, this information alone is not necessarily adequate for a decision on whether the hydrocarbons are economically producible. The pore spaces containing the hydrocarbons may be isolated or may be only slightly interconnected, in which case the hydrocarbons will be unable to flow through the formation to the borehole. The ease with which the fluids can flow through the formation (also known as permeability), should preferably exceed some threshold value to assure the economic feasibility of turning the borehole into a producing well. The threshold value may vary depending on such characteristics, such as viscosity in the case of oil. For example, a highly viscous oil will not flow easily in low permeability conditions and if water injection is to be used to promote production, there may be a risk of premature water breakthrough at the producing well.

The permeability of a formation is not necessarily isotropic. In particular, the permeability for fluid flow in a generally horizontal direction may be different from (and typically greater than) the permeability value in a generally vertical direction. This may arise, for example, from the effects of interfaces between adjacent layers making up a formation, or from anisotropic orientation of formation particles such as sand grains. Where there is a strong degree of permeability and anisotropy, it is important to distinguish the presence and degree of the anisotropy, to avoid using a value dominated by the permeability in only one direction as a misleading indication of the permeability in all directions.

Present techniques for evaluating the vertical permeability of a formation are somewhat limited. One tool that has gained commercial acceptance provides for repeat formation testing (RFT) and is described in U.S. Pat. Nos. 3,780,575 and 3,952,588. This tool includes the capability for repeatedly taking two successive samples at different flow rates from a formation via a probe inserted into a borehole wall. The fluid pressure is monitored and recorded throughout the sample extraction period and for a period of time thereafter. Analysis of the pressure variations with time during the sample extractions (draw-down) and the subsequent return to initial conditions (build-up) enables a value for formation permeability to be derived both for the draw-down and build-up phases of operation.

Another technique is described in U.S. Pat. No. 4,890,487, issued on Jan. 2, 1990, to Dussan et al. In this patent, a technique of measuring horizontal and/or vertical permeability is described. The pressure is measured while the fluid samples are extracted from a subsurface earth formation using a borehole logging tool having a single extraction probe. The pressure and flow data are analyzed to derive separate values for both horizontal and vertical formation permeability. The measured pressure profile is compared with its dimensionless pressure profile (obtained from known values of vertical and horizontal permeabilities).

Another technique that has obtained some widespread acceptance is a technique known as "Vertical Pulse Testing". In this technique, a packer is located along the production tubing to seal an area within the formation. A perforation is made on one location on the casing above the packer and in another location below the packer. The top (or bottom) perforated internal is produced while measuring pressures at the bottom (or top) perforated interval. The pressure drop is somewhat indicative of vertical permeability. However, to use this "Vertical Pulse Testing" method, computations must be made to solve two unknown parameters (vertical permeability and horizontal permeability). Flaws in the casing can cause flow behind the outer skin of the casing so as to affect values. In general, the technique of Vertical Pulse Testing has not proven as a reliable measurement of vertical permeability.

It is an object of the present invention to provide a method for the measurement of vertical permeability that provides an accurate assessment of the vertical permeability of a subsurface earth formation.

It is another object of the present invention to provide a method for the measurement of vertical permeability that can be used during the process of well formation.

It is a further object of the present invention to provide a method for the measurement of vertical permeability that requires no specialized equipment at the well site.

These and other objects and advantages of the present invention will become apparent from a reading of the attached specification and appended claims.

SUMMARY OF THE INVENTION

The present invention is a method and process for determining the vertical permeability of a subsurface earth formation. The method of the present invention comprises the following steps: (1) perforating a production casing for an initial area less than the thickness of the subsurface earth formation; (2) measuring the reservoir fluid flow and pressure through the initial perforations in the production casing; (3) perforating the production casing for a production interval having an area greater than the initial area perforation; (4) measuring the reservoir fluid flow and pressure through the perforated production interval; (5) establishing a value corresponding to horizontal permeability from the measured reservoir fluid flow through the perforated production interval; (6) simulating pressure profiles using values of vertical permeability in combination with the established value of horizontal permeability; and (7) determining the simulated pressure profile which generally corresponds to a measured pressure profile from the initial area perforation.

The initial perforations is an interval located generally adjacent the middle of the subsurface earth formation. In normal applications, this initial perforations would be approximately 10% of the total productive interval.

The method of the present invention further includes the steps, following the initial perforations, of: (1) cementing through the perforated initial area to an exterior of the production casing so as to inhibit vertical fluid communication behind the production casing; and (2) reperforating the perforated initial area so as to allow reservoir fluid to enter the production casing.

The step of measuring the reservoir fluid flow includes the step of displacing completion fluids within the casing so as to establish the reservoir fluid flowrate. It also includes the positioning of a pressure gage near the perforated initial area. In addition, the step of measuring includes the pumping of completion fluids from the production casing, the closing of the production casing so as to allow a build-up of the reservoir fluids, the measuring of downhole pressures during the build-up of these reservoir fluids, and the measuring of the production rate of reservoir fluids from the subsurface earth formation. The well may be closed prior to the step of perforating the production interval. The production interval has an area which rough corresponds to the thickness of the subsurface earth formation.

The step of establishing a value corresponding to horizontal permeability includes the steps of: (1) obtaining values relating to horizontal permeability, skin damage, and reservoir pressure from the measured reservoir fluid flow through the perforated production interval; (2) creating a pressure profile based upon the obtained values; and (3) deriving a horizontal permeability value from the pressure profile for the perforated production interval. The step of simulating further comprises the steps of: (1) deriving a measured pressure profile from the measured reservoir fluid flow through the initial area perforation; and (2) producing a plurality of simulated pressure profiles using the derived horizontal permeability value and a plurality of selected vertical permeability values. The produced simulated pressure profile which corresponds most closely to the measured pressure profile is selected. The vertical permeability value for this pressure profile is then the vertical permeability value for the subsurface earth formation.

DETAILED DESCRIPTION OF THE INVENTION

The present invention is a method of determining vertical permeability of a subsurface earth formation. In particular, the process described herein is used to determine the permeability perpendicular to the bedding plane (hereinafter referred to as vertical permeability)

of an underground porous reservoir. Permeability is the measure of the ease of flow of fluid in a porous media. Permeability is defined by Darcy's Law, as follows:

$$v = \frac{k}{\mu} \frac{dP}{dL} \quad (1)$$

where
$v$=velocity of fluid
$\mu$=viscosity
k=permeability
dP=pressure drop
dL=length A reservoir is a porous rook which contains mobile and immobile fluids. The vertical permeability value is required for proper reservoir management. In particular, the vertical permeability value can provide useful information to the reservoir operator. The vertical permeability can provide information to the operator as to whether to water flood the reservoir or not, whether to inject carbon dioxide, or whether to flood with polymers.

Figure 1:
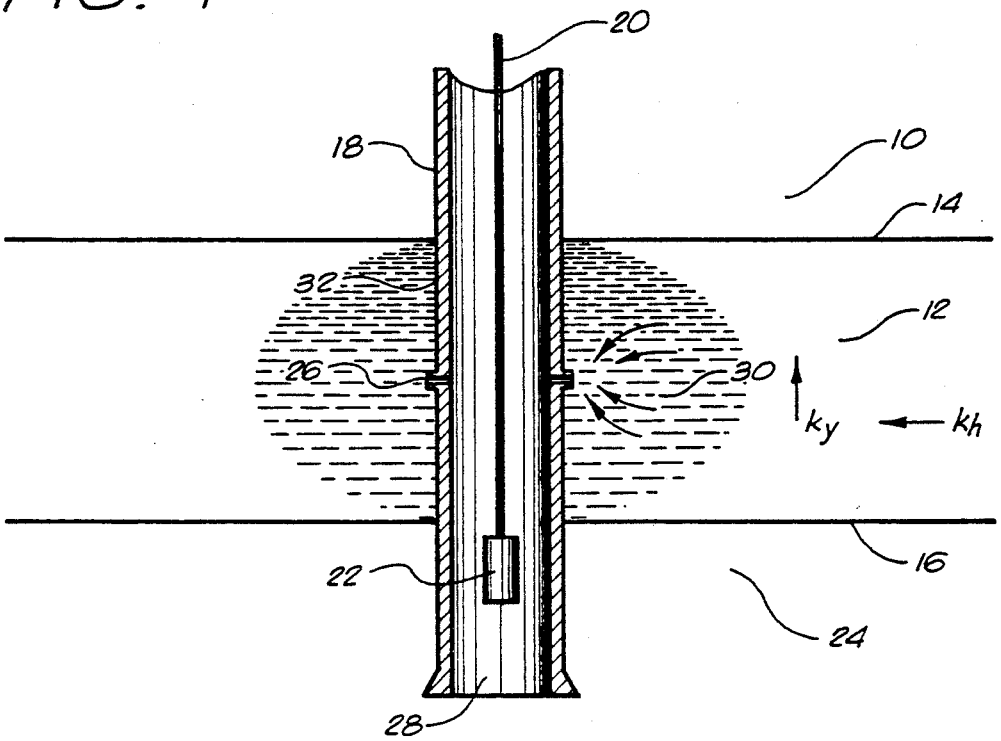
FIG. 1 is an illustration of the initial area perforations of the well casing within a formation.

Referring to FIG. 1, there is shown the subsurface earth formation 10. The subsurface earth formation 10 has a production interval 12 contained therein. Production interval 12 extends from cap rock 14 to base rock 16. The reservoir fluid is contained within this production interval 12. The production casing 18 is set in the manner described herein (see Background of Invention). A wire line 20 is shown as extending through the interior of production casing 18 and has a pressure gage 22 at one end. The production casing 18 extends through the productive formation 12 and extends downwardly below base rock 16 into the earth 24.

The initial step of the method of the present invention is to perforate middle 10% shown by area 26 of the productive interval 12. This perforation 26 can occur for an initial area less than the thickness of the production interval 12. The perforation was carried out in the manner described herein previously (see "Background of the Invention"). The perforation 26 opens the interior 28 of production casing 18 to the flow of reservoir fluids 30. The reservoir fluids 30 enter the production casing 18 by way of the perforation 26.

In the preferred embodiment of the present invention, after the perforation 26 is completed, a cementation process may be carried out. Essentially, cement is squeezed through the production interval 26 into the formation 12. The cement will tend to close any gaps between the subsurface earth formation 10 and the exterior surface 32 of the production casing 18. By sealing any gaps that might exist between the exterior surface 32 of production casing 18 and the subsurface earth formation, any behind-pipe vertical communication of the reservoir fluid is prevented. This "behind-pipe" vertical communication could otherwise create distortions in the calculation of vertical permeability. Such "behind-pipe" vertical communication has, in the past, caused great problems for Vertical Pulse Testing techniques of vertical permeability measurement. Although it is not critical to the method of the present invention to carry out this cementation process, it is believed that the preferred embodiment of the present invention would carry out such a technique. If economics, and other reasons, would dictate that the cementation process not be carried out, then the present method would still function effectively. As such, the cementation process should not be considered as an limitation of the present invention.

After the cement has been squeezed through the perforation 26, and the cement has set, the production casing 18 is then reperforated throughout the same middle interval 26. It is only necessary that the reperforation occur in generally the same area as the original perforation 26. Ideally, the reperforation should be located generally about the middle of the production interval 12.

After the production casing 18 has been perforated in the manner illustrated in FIG. 1, the reservoir fluids 30 are free to enter the small perforated interval 26. The fluid entering the casing 18 will have a horizontal permeability factor and a vertical permeability factor. This is because the reservoir fluid 30 will be entering the casing from a variety of different directions. The reservoir fluid flow 30 will enter the interior 28 of production casing 18 and displace any completion fluids which are contained within the casing 18. The pressure gage 22, and equipment at the surface of the well, can be used to establish reservoir fluid flow. For the purposes of the present invention, it is important to measure the reservoir fluid flow through this initial perforation 26 in the production casing 18. If the reservoir 10 is capable of flowing, then a flow test is carried out followed by a build-up test with bottomhole pressure measurements carried out by pressure gage 22. However, if the reservoir is not capable of producing on its own, then a suitable downhole pump is installed. The downhole pump will pump the fluids from the production casing 18 for a reasonable time. The well will then be "shut in" so that fluids may build up and downhole pressures may be measured by pressure gage 22. Additionally, the production rate of oil, gas, and water can be measured during the flow through the perforation 26. As with standard downhole procedures, many other values may be obtained relative to the reservoir fluid flow through the perforation 26, such as temperature, volume, pressure, and other standard measurements.

Figure 2:
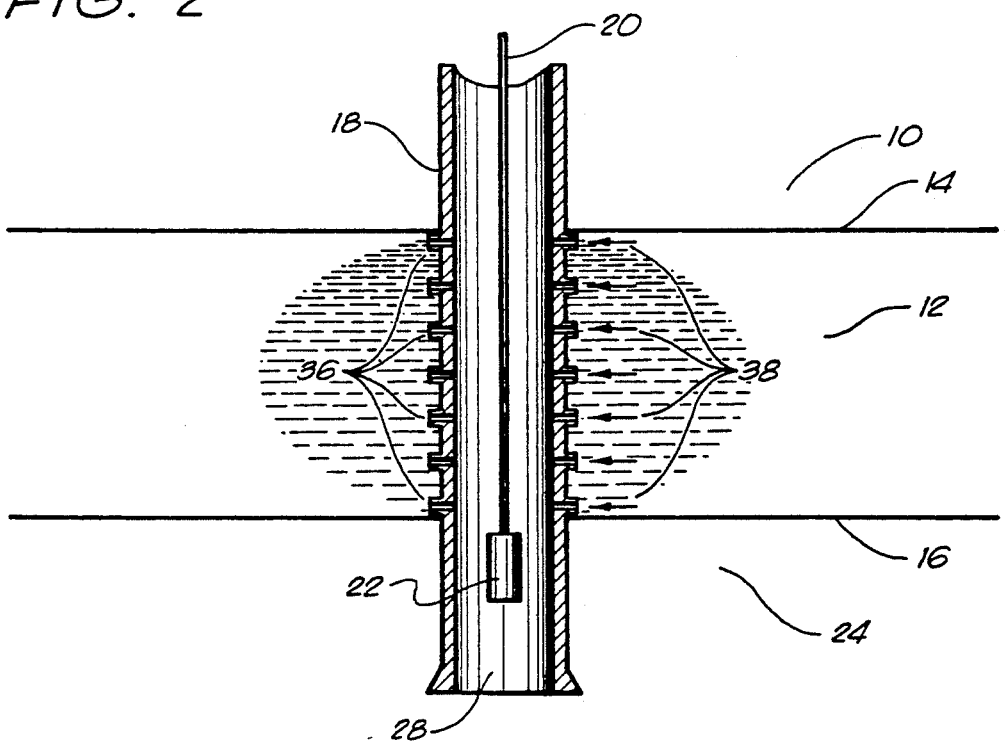
FIG. 2 is an illustration of the complete perforation of the production interval in the casing within the formation.

After all the measurements are taken of the reservoir fluid flow through the initial perforation 26, the well is then killed. The next step is to perforate the entire producing interval as is illustrated in FIG. 2. As illustrated in FIG. 2, a perforating tool is used so as to perforate the entire producing interval between cap rock 14 and base rock 16, otherwise identified as the production interval 12. During typical logging techniques, the area of the production interval 12 is identified. The perforations 36 are carried out throughout the entire interval 12. This opens the interior 28 to the full flow of reservoir fluids 38 from this interval. As is illustrated by the lines showing the fluid flow 38, the fluid flow 38 is generally horizontal in direction. When the entire production interval of the casing 18 is perforated, virtually all of the reservoir fluid flow will be in the horizontal direction. There is a "de minimus" amount of vertical fluid movement which will occur in the scheme illustrated in FIG. 2. As such, the arrangement of FIG. 2 is particularly appropriate for horizontal permeability testing.

As the reservoir fluid 38 flows into the perforations 36, any completion fluids within the interior 28 of production casing 18 are displaced and reservoir fluid flow can be established. If the reservoir is not capable of flowing, then the completion fluids should be pumped out of the casing 18, the well shut in, and build-up of the reservoir fluids allowed to occur. Measurements are made of reservoir fluid flow, bottomhole pressures, and other values. Generally, the production rate of all the fluid produced, such as oil, gas, and water, is measured. Pressure gage 22, and other instruments, can be used to carry out the necessary measurements of the scheme illustrated in FIG. 2.

After the measurements are taken from the procedures illustrated in FIGS. 1 and 2, it is necessary to establish a value corresponding to the horizontal permeability. Initially, the horizontal permeability can be calculated from the measured reservoir fluid flow through the perforated production interval of FIG. 2. To establish horizontal permeability, it is necessary to take measured data from the entirely perforated production interval. A pressure profile can be established in the manner illustrated in FIG. 3.

Figure 3:
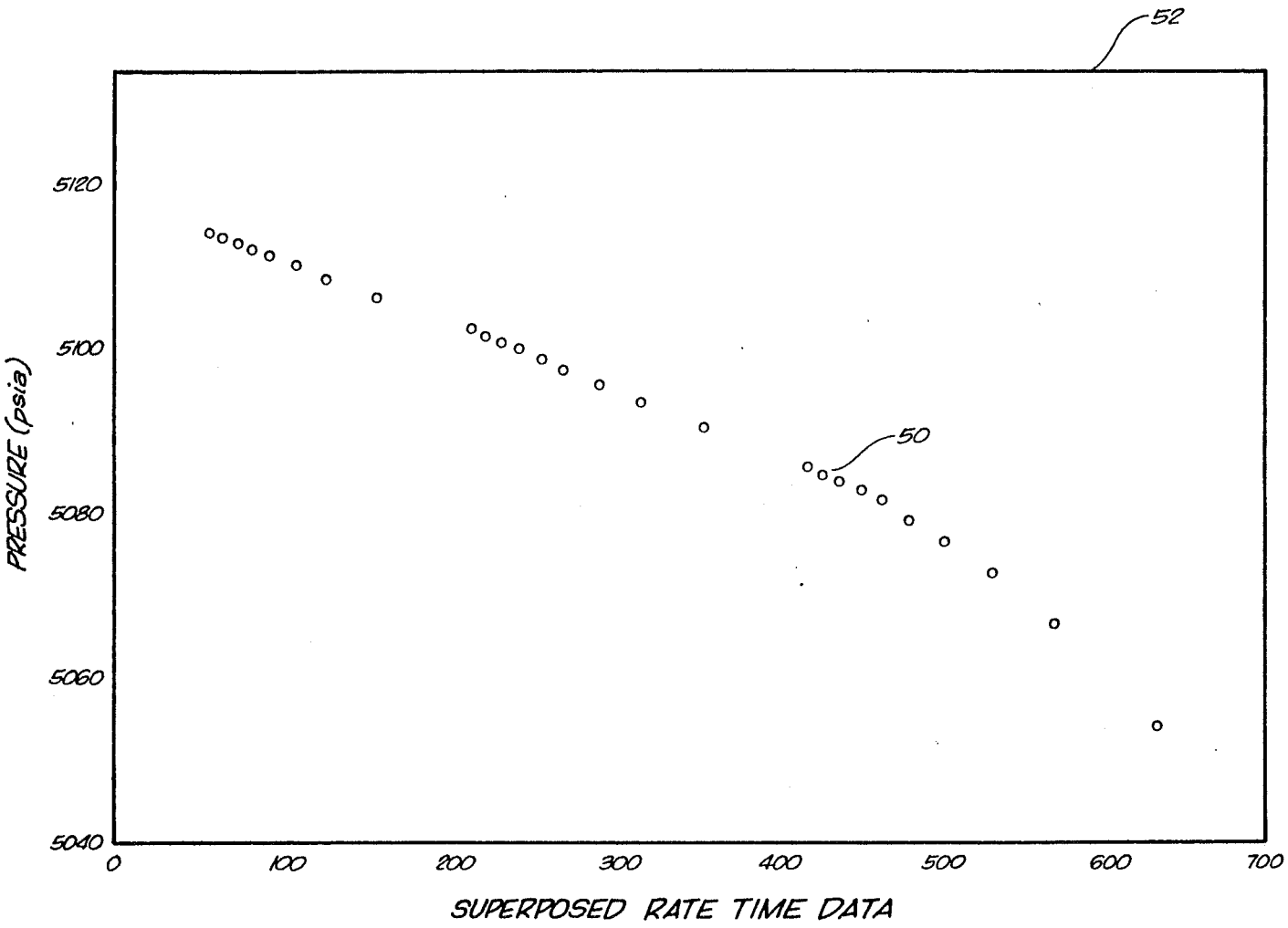
FIG. 3 is a pressure profile showing the complete perforation of the production interval of FIG. 2.

FIG. 3 shows a pressure profile 50 which is plotted on a horizontal axis showing "superposed rate-time" and a vertical axis showing "pressure". Superposed rate-time is a convenient value to use as an axis for the requirements of the analysis of the present invention. Superposed rate-time for constant production rate case is shown by the following formula:

$$\text{Superposed Rate-Time} = q \log \frac{t + \Delta t}{\Delta t} \quad (2)$$

where
q=production rate
t=flow time
Δt=shut-in time

The calculation of horizontal permeability can be carried out by the formula:

$$m = \frac{162.6\mu B}{k_h h} \quad (3)$$

where
m=slope of line
$\mu$=viscosity
B=formation volume factor
$k_h$=horizontal permeability
h=thickness of production interval Essentially, the slope of the pressure profile 50 illustrated in the graph 52 of FIG. 3 determines horizontal permeability of the subsurface earth formation. This measurement of horizontal permeability is taken from the entirely perforated casing 18 of FIG. 2. The measurement of horizontal permeability from this entirely perforated interval is proper since the value of vertical permeability will be virtually zero. There is virtually no vertical permeability factor that comes into play when the production interval is entirely perforated. In addition to the determination of horizontal permeability, other values can be obtained from the entirely perforated zone. Values for skin damage and reservoir pressure are obtained from the conventional analysis of data taken from the reservoir fluid flow.

Figure 4:
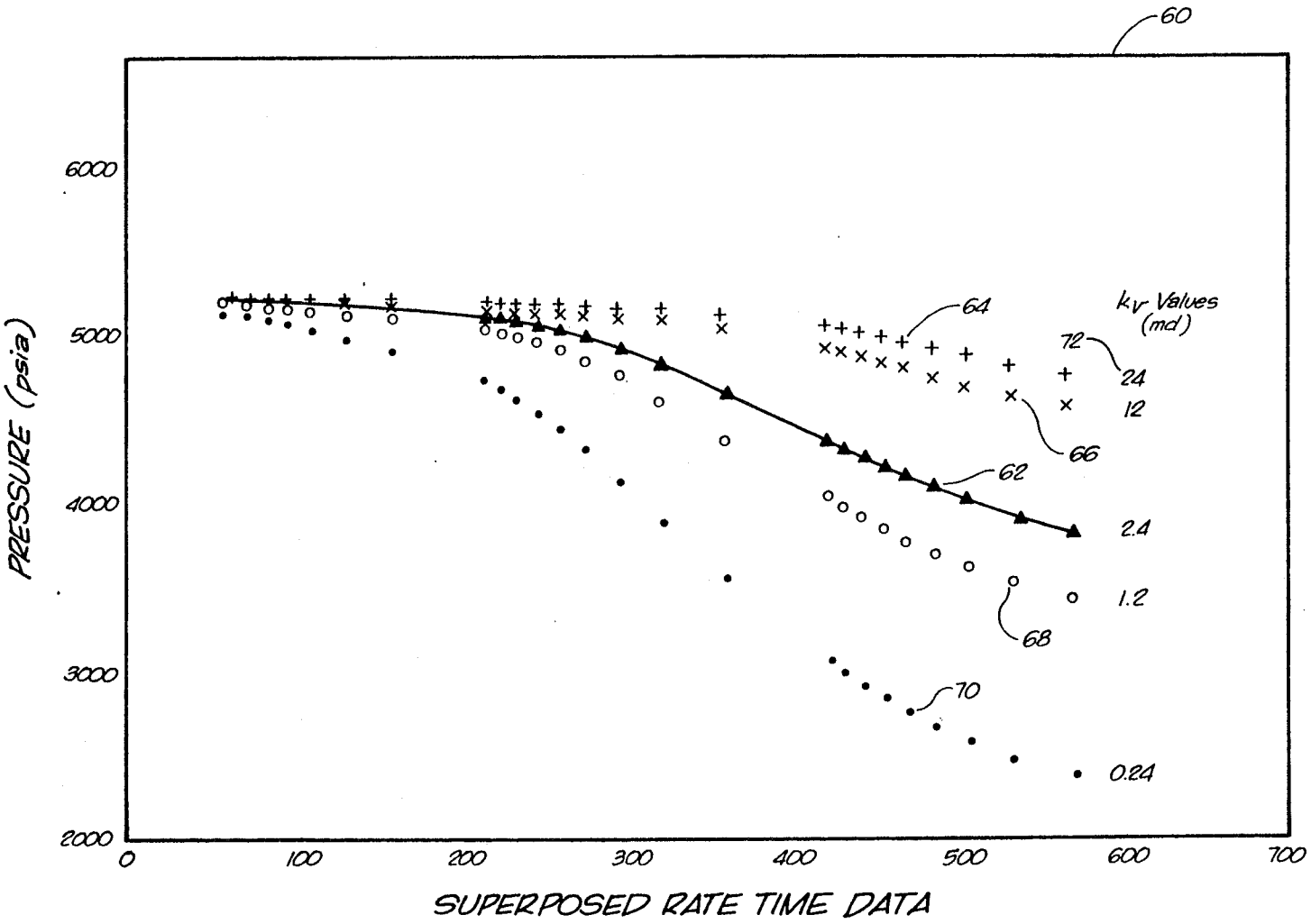
FIG. 4 is a pressure profile showing the simulated pressure profiles with a plurality of vertical permeability factors.

FIG. 4 illustrates graph 60. Graph 60 is a pressure profile somewhat similar to the pressure profile analysis carried out in conjunction with FIG. 3. However, the graphical analysis contained in FIG. 4 represents the configuration of data as obtained from the initial area perforation as shown in FIG. 1.

In order to determine vertical permeability, conventional analysis of the data is not possible. As can be seen in FIG. 4, the data taken from the measurements of reservoir fluid flow through the initial area perforation of FIG. 1 is represented by the solid line 62. After the line 62 is plotted in FIG. 4, it is then necessary to utilize the known horizontal permeability number so as to create calculations that can lead to the determination of vertical permeability for the formation.

A numerical model can be used to simulate the flow of single phase oil, gas, or water in cylindrical coordinates. The partial differential equations are approximated using a finite difference method. This method is described by the following equations:

$$(\Delta_r T_r \Delta_r \phi + \Delta_o T_o \Delta_o \phi + \Delta_z T_z \Delta_z \phi^n_{i,j,k} + 1 - q_{i,j,k}) = \left(\frac{V_p c^*}{\Delta t}\right)_{i,j,k} \delta\phi \quad (4)$$

The additional pressure drop due to skin effect is given by:

$$\Delta\phi_{i,j,k} = \frac{S}{0.00633(2\pi\alpha)(k_r \Delta t)} q_{i,j,k} \quad (5)$$

The wellbore storage effects are included using:

$$q_1 + \ldots q_{NO} = q + c\frac{dp_w}{d\phi_w} (\phi_w^{n+1} - \phi_w^n) \quad (6)$$

The transmission terms ($T_r$, $T_o$, and $T_z$) can be modified to account for turbulence as follows:

$$T_r = \frac{2\pi\alpha\Delta z k_r}{\ln\left(\frac{r_2}{r_1}\right) + \frac{\beta M k_r}{2\pi\alpha\Delta z R T_R \mu} q \left(\frac{1}{r_1} - \frac{1}{r_2}\right)} \quad (7)$$

The $T_o$ and $T_z$ can be similarly expanded. The nomeclature for these equations is as follows:

NOMENCLATURE

T=Transmissibility (md-ft)
$V_p$=Pore volume (MCF or STB)
$\phi$=Potential =

$$\int_{p_1}^{p_2} \frac{dp}{\mu\beta} \text{ (psi/cp)}$$

B=Formation Volume factor (RB/MCF or RB/STB)
c*=Compressibility (vol/vol/psi)
q=Production rate (MCF/D or STB/D)
p=pressure (psia)
Δt=Time step (days)
$\alpha = T_{SC}/(1000\, p_{sc}\, T_r)$,
$T_{SC}$=Standard temperature, °R
$p_{SC}$=Standard pressure, psia
$T_R$=Reservoir temperature, °R
z=Real gas deviation factor (dimensionless)
$\mu$=Viscosity (cp)
C=Wellbore storage (RB/psi)
S=Skin damage (dimensionless)
$\beta$=Turbulent coefficient (feet$^{-1}$)
M=Molecular weight
R=Gas constant Subscripts and Superscripts r=radial coordinate
$\theta$=angular coordinate
z=vertical coordinate
w=wellbore
n=nth time step
i=i location of a grid
j=j location of a grid
k=k location of a grid
NR=number of radial blocks
N$\theta$=number of $\theta$ blocks
NZ=number of z blocks
NQ=number of sectors adjacent to the wellbore The above equations can be solved by standard mathematical techniques and methods.

It is necessary to simulate pressure profiles in the manner illustrated in FIG. 4. Pressure profiles 64, 66, 68 and 70 are the pressure profiles based on this model for various values of vertical permeability. The values of vertical permeability are shown at the end of each of these lines as the values indicated in column 72. Using Darcy's Law, it becomes possible to create the pressure profile using the values 72 of vertical permeability.

The initial pressure profile 64 is a pressure profile arrived at by utilizing a vertical permeability value equal to the horizontal permeability value (in this case equal to 24 md). Vertical permeability is expected to be, at the most, equal to the horizontal permeability and generally is not greater than horizontal permeability. Since the pressure profile 64 is quite different from the given pressure profile 62, it can be assumed that the value "24" is not accurate for the formation being analyzed. Similarly, it can be seen that the pressure profile 66 created by using a vertical permeability value of 12 md is also not in alignment with the given pressure profile 62. As such, in the simulation carried out by the analysis of the data provided, a much lower value of vertical permeability is necessary.

Pressure profile 70 illustrates what happens when a very low vertical permeability value (0.24 md) is chosen. As can be seen, the slope of the pressure profile 70 is quite great. The slope of line 70 indicates that the value "0.24 md" is not appropriate for the particular formation being analyzed. The pressure profile 70 is quite different than the given value 62. Similarly, the pressure profile 68 is quite different from the given pressure pressure profile 62.

After several iterations of data using various values of vertical permeability, eventually, a simulated value of 2.4 md will create a pressure profile that matches the given line 62. When the simulated pressure profile line matches the given line, then the conclusion is that the value of vertical permeability is appropriate. In the case illustrated in FIG. 4, the accurate vertical permeability value of the subsurface earth formation is "2.4 md". The conclusion of the analysis is arrived at by systematically changing the vertical permeability value so as to obtain a reasonable match between the measured pressure profile and the modeled pressure profile. The vertical permeability which results in the best match, or most closely corresponds, is the most likely vertical permeability value for the formation.

If, despite many iterations of data, it is not possible to obtain an identical match between the measured pressure profile, and the modeled pressure profile, then the modeled pressure profile which most closely matches the measured pressure profile is chosen as indicative of the proper vertical permeability value.

The method of the present invention enhances the ability to make a proper determination of vertical permeability. An accurate determination of vertical permeability is important in the analysis of reservoir data. Ultimately, an accurate vertical permeability value can be useful in the exploitation of the well or the development of the resources of the well. The present invention requires no additional equipment other than the equipment employed in the creation of the well. The data obtained from the analysis of reservoir fluid flow is data that is normally kept during the course of oil well development. The important difference in the procedures employed by the present invention is the initial well perforation, followed by a production interval perforation, followed by an iterative analysis of data. However, the procedures employed by the present invention are a significant improvement over prior techniques of vertical permeability determination. The analysis of vertical permeability, as contemplated by the present invention, is a significant advance in the analysis of oil field data. The present invention allows for the reliable determination of vertical permeability.

The analysis of the data as obtained from the present invention and as utilized by the present invention, can be incorporated into software. As such, pressure profiles can easily be created and analyzed in the field. As a result, once the data is obtained from the analysis of reservoir fluid flow, such data can be entered onto the computer so that a rapid analysis can be obtained. The values of vertical permeability can then be available to the operators of the well so that a proper analysis of the productivity of the well can be obtained. Additionally, the value of vertical permeability can assist in later reservoir management.

The foregoing disclosure and description of the invention is illustrative and explanatory thereof. Various details in the described method may be changed within the scope of the present invention. The present invention should only be limited by the following claims and their legal equivalents.

I claim:

1. A method of determining vertical permeability of a subsurface earth formation comprising the steps of:

perforating a production casing for an initial area less than a thickness of the subsurface earth formation;

measuring reservoir fluid flow and pressure through the initial area perforation in said production casing;

perforating said production casing for a production interval having an area greater than said initial area;

measuring reservoir fluid flow and pressure through the perforated production interval;

establishing a value corresponding to horizontal permeability from the measured reservoir fluid flow through the perforated production interval;

simulating pressure profiles using values of vertical permeability in combination with the established value of horizontal permeability; and determining the simulated pressure profile which generally corresponds to a measured pressure profile from said initial area perforation.

2. The method of claim 1, said initial area being an interval located generally adjacent a middle of said subsurface earth formation.

3. The method of claim 2, said initial area being roughly 10% of the production interval on said production casing.

4. The method of claim 1, further comprising the steps of:

cementing through the perforated initial area to an exterior of said production casing so as to inhibit vertical fluid communication behind said production casing; and reperforating the perforated initial area so as to allow reservoir fluid to enter said production casing.

5. The method of claim 1, said step of measuring reservoir fluid flow comprising the step of:

displacing completion fluids within said casing so as to establish reservoir fluid flow.

6. The method of claim 1, said step of measuring comprising:

pumping completion fluids from the production casing;

closing said production casing so as to allow a build-up of reservoir fluids;

measuring downhole pressures during the build-up of reservoir fluids; and measuring the production rate of reservoir fluids from said subsurface earth formation.

7. The method of claim 1, further comprising:

closing the well prior to the step of perforating the production interval.

8. The method of claim 1, said production interval having an area generally equal to the thickness of said subsurface earth formation.

9. The method of claim 1, said step of establishing comprising:

obtaining values relating to horizontal permeability, skin damage, and reservoir pressure from the measured reservoir fluid flow through the perforated production interval;

creating a pressure profile based upon the obtained value; and deriving a horizontal permeability value from the created pressure profile for the perforated production interval.

10. The method of claim 9, said step of simulating comprising:

deriving a measured pressure profile from the measured reservoir fluid flow through the perforated initial area; and producing a plurality of simulated pressure profiles using the derived horizontal permeability value and a plurality of selected vertical permeability values.

11. The method of claim 10, said step of simulating further comprising:

selecting the produced simulated pressure profile which corresponds most closely to the measured pressure profile.

12. A process for determining vertical permeability of a subsurface earth formation comprising the steps of:

perforating a production casing in an initial area within the subsurface earth formation;

cementing through the perforated initial area to an exterior of said production casing so as to inhibit vertical fluid communication behind said production casing;

reperforating the perforated initial area so as to allow reservoir fluid to enter said production casing from said subsurface earth formation;

measuring reservoir fluid flow and pressure through the reperforated initial area into the production casing;

perforating said production area for a production interval having an area greater than said initial area;

measuring reservoir fluid flow and pressure through the perforated production interval;

deriving a horizontal permeability value from the measured reservoir fluid flow and pressure through the perforated production interval; and simulating values of vertical permeability so as to create pressure profiles corresponding to a measured pressure profile from the reperforated initial area.

13. The process of claim 12, said initial area being an interval less than a thickness of the subsurface earth formation and located generally near a middle of the subsurface earth formation, said production interval generally corresponding to the thickness of the subsurface earth formation.

14. The process of claim 12, said step of deriving a horizontal permeability value comprising:

obtaining values relating to horizontal permeability, skin damage, and reservoir pressure from the measured reservoir fluid flow and pressure through the perforated production interval;

creating a pressure profile based upon the obtained value; and deriving a horizontal permeability value from the pressure profile for the perforated production interval.

15. The process of claim 14, said step of simulating comprising:

deriving a measured pressure profile from the measured reservoir fluid flow and pressure through the reperforated initial area; and producing a plurality of simulated pressure profiles using the derived horizontal permeability value and a plurality of selected vertical permeability values.

16. The process of claim 15, said step of simulating further comprising:

selecting the produced simulated pressure profile which corresponds most closely to the measured pressure profile.

17. A process for determining vertical permeability of a subsurface earth formation comprising the steps of:

perforating a production casing in an initial area positioned within the subsurface earth formation, said initial area being less than a thickness of the subsurface earth formation;

measuring reservoir fluid flow and pressure through the initial area perforation in the production casing;

perforating said production casing for a production interval having an area greater than the initial area perforation and generally corresponding to the thickness of the subsurface earth formation;

measuring reservoir fluid flow and pressure through the perforated production interval;

establishing a value corresponding to horizontal permeability from the measured reservoir fluid flow and pressure through the perforated production interval;

simulating pressure profiles for the initial area perforation utilizing the established value of horizontal permeability and a plurality of vertical permeability values; and selecting the vertical permeability value from the pressure profile which corresponds most closely to a measured pressure profile from the initial area perforation.

18. The process of claim 17, further comprising the steps of:

cementing through the perforated initial area to an exterior of the production casing so as to inhibit vertical fluid communication behind said production casing; and reperforating the perforated initial area so as to allow reservoir fluid to enter the production casing.

* * * * *